US012398607B2

(12) United States Patent
Strohla

(10) Patent No.: US 12,398,607 B2
(45) Date of Patent: Aug. 26, 2025

(54) SWIVEL SUB WITH INTERMEDIATE LUG FOR EXTENDED ROTATION

(71) Applicant: Halliburton Energy Services, Inc., Houston, TX (US)

(72) Inventor: Nick Strohla, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 314 days.

(21) Appl. No.: 18/204,312

(22) Filed: May 31, 2023

(65) Prior Publication Data

US 2024/0401425 A1 Dec. 5, 2024

(51) Int. Cl.
*E21B 23/02* (2006.01)

(52) U.S. Cl.
CPC ..... *E21B 23/02* (2013.01)

(58) Field of Classification Search
CPC ..... E21B 23/02; E21B 17/05; E21B 17/023
See application file for complete search history.

(56) References Cited

U.S. PATENT DOCUMENTS

| | | | | |
|---|---|---|---|---|
| 4,688,649 | A | 8/1987 | Buck | |
| 8,061,430 | B2 | 11/2011 | Du et al. | |
| 8,511,392 | B2 | 8/2013 | Howlett et al. | |
| 9,683,412 | B2 | 6/2017 | Richards | |
| 9,784,073 | B2 | 10/2017 | Bailey et al. | |
| 2005/0045339 | A1* | 3/2005 | Hall | E21B 17/003 166/380 |
| 2006/0213670 | A1 | 9/2006 | Bishop et al. | |
| 2016/0168923 | A1* | 6/2016 | Richards | E21B 43/04 166/227 |
| 2019/0169941 | A1* | 6/2019 | Bauer | E21B 17/07 |
| 2021/0254432 | A1 | 8/2021 | Honeker et al. | |
| 2022/0090879 | A1 | 3/2022 | Walker et al. | |
| 2023/0167712 | A1* | 6/2023 | Pearce | H02K 5/132 166/381 |

OTHER PUBLICATIONS

International Search Report and Written Opinion for International Patent Application No. PCT/US2023/025769 dated Feb. 20, 2024. PDF file. 9 pages.

* cited by examiner

*Primary Examiner* — Theodore N Yao
(74) *Attorney, Agent, or Firm* — Scott Richardson; C. Tumey Law Group PLLC

(57) ABSTRACT

An apparatus may include a connector sub rigidly securable to a conveyance for running the connector sub along a wellbore. The connector sub has a connector lug. Further, the apparatus may include a spool mandrel having a mandrel lug that is rotatable with respect to the connector sub. Additionally, the apparatus may include an intermediate sub disposed between the connector sub and the spool mandrel. The intermediate sub includes an intermediate lug extending outward from an outer surface of the intermediate sub and contact between the intermediate lug, the connector lug, and the mandrel lug bounds rotational movement of the spool mandrel with respect to the connector sub between a first angular position and a second angular position.

20 Claims, 9 Drawing Sheets

SWIVEL SUB WITH INTERMEDIATE LUG FOR EXTENDED ROTATION

BACKGROUND

In the process of completing an oil or gas well, various downhole tools (e.g., flow regulating systems, production packers, etc.) may be run-in-hole to assist in production operations. For example, a flow regulating system may be disposed proximate a producing formation. The flow regulating system may have a screen assembly that controls and limits debris, such as gravel, sand, and other particulate matter, from entering the tubular as the fluid passes through the screen assembly from the producing formation. The flow regulating system or other downhole tools may include completion devices (e.g., valves, sensors, actuators, etc.) that require electricity and/or control signals (e.g., electrical, light, or hydraulic) from the surface to operate.

However, these downhole tools may not extend to the surface as they may be disposed deep in the wellbore proximate the producing formation. As such, running a control line from the surface to the downhole tools may be required to operate these downhole tools. Unfortunately, the tubular running the control line and/or the downhole tool may rotate or twist from their respective surface orientations while being run-in-hole, and failing to achieve a particular angular orientation between the control line and the downhole tool requires adjustments, which may be time consuming and costly. Further, over rotation of the tubular may strain and damage the control line, which may interrupt production operations.

BRIEF DESCRIPTION OF THE DRAWINGS

These drawings illustrate certain aspects of some of the embodiments of the present disclosure and should not be used to limit or define the method.

DETAILED DESCRIPTION

Disclosed herein are systems and methods for connecting a downhole tool with the surface via a control line. Example embodiments may include an apparatus (e.g., a swivel sub) for running the control line to the downhole tool. The apparatus includes a connector sub rigidly secured to a conveyance (e.g., tubular), a spool mandrel that is rotatably coupled to the connector sub, and an intermediate sub disposed between the connector sub and the spool mandrel. The control line extends from the surface along the conveyance and across the swivel sub. The control line is displaceable to permit at least some rotation of the spool mandrel with respect to the connector sub without straining and damaging the control line. To reduce strain to the control line, rotation of the spool mandrel with respect to the connector sub is limited between a first angular position and a second angular position by contact between a connector lug of the connector sub, an intermediate lug of the intermediate sub, and a mandrel lug of the spool mandrel to prevent over rotation of the spool mandrel, which may strain and damage the control line. However, rotation of the swivel sub between the first angular position and the second angular position may be sufficient rotation to allow the control line to be moved into the correct angular orientation to couple with the downhole tool such that electricity and/or control signals (e.g., electrical, light, and/or hydraulic) may be transmitted between the surface to the downhole tool.

Figure 1:
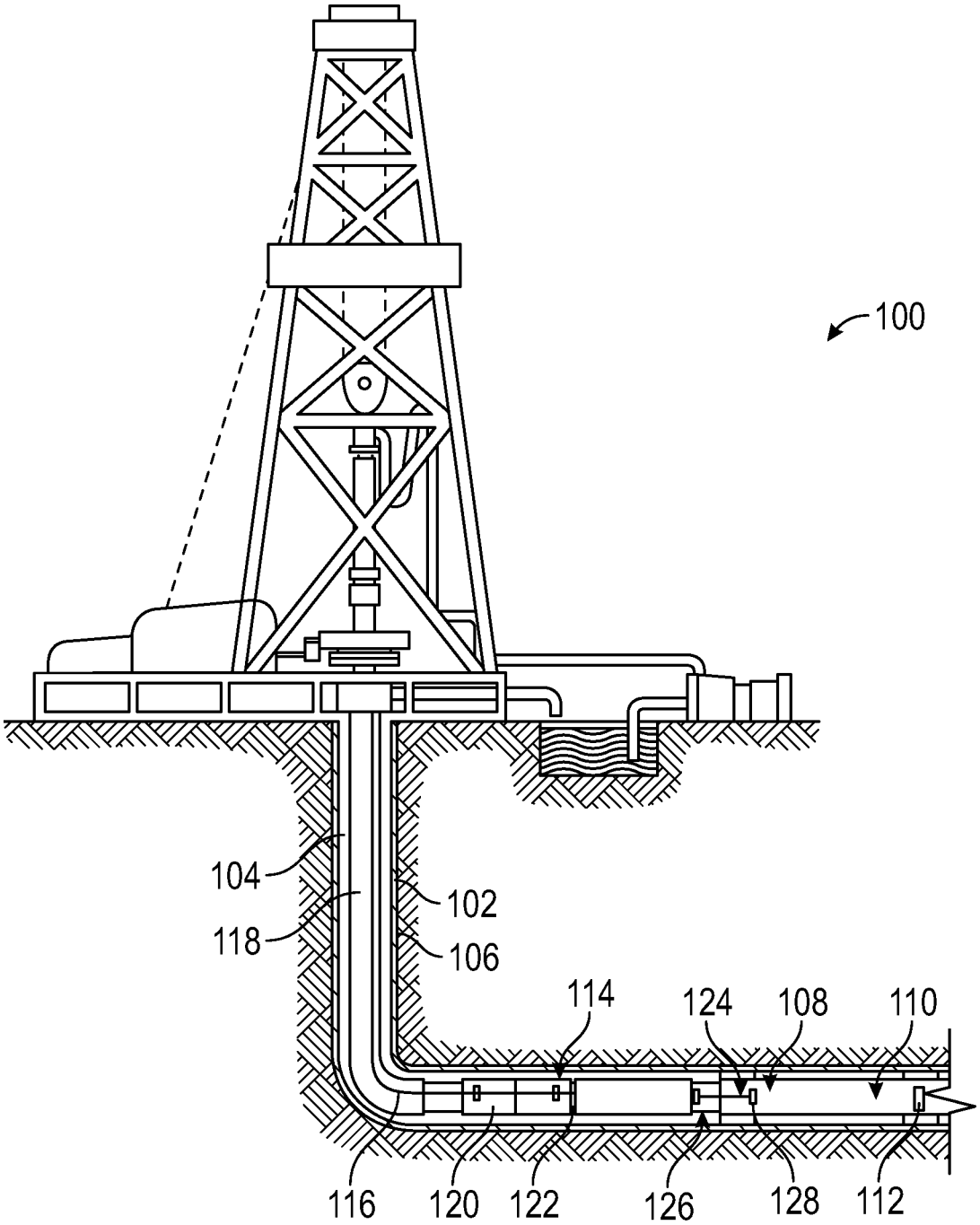
FIG. 1 illustrates an elevation view of a well system, in accordance with some embodiments of the present disclosure.

FIG. 1 illustrates an elevation view of a well system 100, in accordance with some embodiments of the present disclosure. As illustrated, casing 102 may be run into a wellbore 104 to protect the wellbore 104 from failure (e.g., collapse, erosion) and provide a fluid path for hydrocarbons during production. To access the hydrocarbons for production, a perforating gun system may be deployed into the casing 102 to form perforations in the casing 102 and wellbore wall 106 such that hydrocarbons may flow into the casing 102 via the perforation. Various downhole tools 108 may be run-in-hole once the perforations are formed. For example, a flow regulating system 110 may be disposed proximate the perforations. The flow regulating system 110 may control and limits debris, such as gravel, sand, and other particulate matter, from entering the casing 102 as the fluid passes through the flow regulating system 110 from the perforations. Further, the flow regulating system 110 or downhole tools 108 may include completion devices 112 (e.g., valves, sensors, actuators, etc.) that require electricity and/or control signals (e.g., electrical, light, hydraulic) from the surface to operate. Accordingly, as set forth above, a swivel sub apparatus 114 may be run-in-hole with a control line 116 to couple the control line 116 to the respective downhole tool 108 such that electricity and/or control signals may be transmitted between the surface to the downhole tool 108.

In particular, the swivel sub 114 may be run-in-hole, via a conveyance 118 (e.g., a tubular). The swivel sub 114 includes a connector sub 120 rigidly secured to the conveyance 118 such that rotational, axial, and radial movement between the connector sub 120 and the conveyance 118 are restrained. For example, the connector sub 120 may be threaded onto the conveyance 118. The swivel sub 114 further includes a spool mandrel 122 that is rotatably coupled to the connector sub 120 and an intermediate sub (shown in FIG. 3) disposed between the connector sub 120 and the spool mandrel 122. The connector sub 120, spool mandrel 122, and intermediate sub may each comprise a short section of piping/tubular material (e.g., a short drill collar, thread crossover, etc.) Moreover, the control line 116 extends from the surface along the conveyance 118 and across the swivel sub 114 such that a mating end 124 of the control line 116 is disposed at a downhole end 126 of the swivel sub 114. The control line 116 may be displaceable to prevent strain on the control line 116 from rotation or twisting of the conveyance 118 as the swivel sub 114 is run-in-hole. Further, as set forth above, the control line 116 is also displaceable to permit rotation of the spool mandrel 122 with respect to the connector sub 120 between a first angular position and a second angular position (shown in FIGS. 5A-E).

The swivel sub 114 may be configured to only couple to the downhole tool 108 in a particular angular orientation. As such, the spool mandrel 122 may rotate between the first angular position and the second angular position to align the mating end 124 of the control line 116 with a corresponding connector 128 of the downhole tool 108 as the conveyance 118 drives the swivel sub 114 toward and/or into the downhole tool 108. Contact between the swivel sub 114 and the downhole tool 108 may drive rotation of the swivel sub 114 to the particular angular orientation with respect to the downhole tool 108. The swivel sub 114 and/or the downhole tool 108 may comprise at least one guide feature configured to drive rotation of the spool mandrel 122 of the swivel sub 114 in response to contact between the swivel sub 114 and the downhole tool 108. Alternatively, the swivel sub 114 may be configured to self-rotate to the particular angular orientation via any suitable mechanical, electrical, hydraulic, pneumatic, and/or magnetic driving mechanism. Driving the swivel sub 114 into the downhole tool 108 in the particular angular orientation (e.g., with the mating end 124 of the control line 116 aligned with the corresponding connector 128) may couple the control line 116 with the downhole tool 108 to put the downhole tool 108 in electrical communication with the surface such that electricity and/or control signals may be transmitted between the surface and the downhole tool 108.

Moreover, the conveyance 118 may pull the swivel sub 114 in the uphole direction to disengage the swivel sub 114 from the downhole tool 108 in response to an unsuccessful coupling of the control line 116 with the downhole tool 108. As set forth in greater detail below, the swivel sub 114 may include a return spring (shown in FIG. 6) to drive the spool mandrel 122 to rotate toward a neutral angular position of the spool mandrel 122 with respect to the connector sub 120 in response to disengaging the swivel sub 114 from the downhole tool 108. Having the swivel sub 114 in the neutral position may be ideal for coupling with the downhole tool 108 as the spool mandrel 122 may be configured to rotate freely from the neutral position to align the control line 116 with the corresponding connector 128 of the downhole tool 108. Accordingly, with the swivel sub 114 in the neutral position, the conveyance 118 may drive the swivel sub 114 into the downhole tool 108 to re-attempt to couple the control line 116 with the downhole tool 108. Having the return spring bias the swivel sub 114 to the neutral position, in response to disengaging the swivel sub 114 from the downhole tool 108, may permit the swivel sub 114 to re-attempt to couple with the downhole tool 108 from an ideal angular position after each disengagement from the downhole tool 108.

Figure 2A:
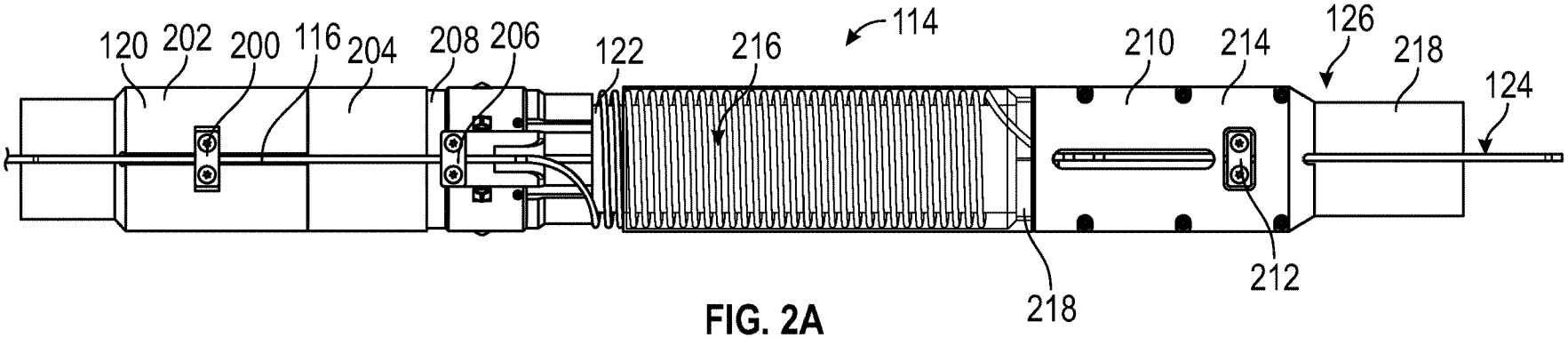
FIGS. 2A-B illustrate respective side views of a swivel sub apparatus, in accordance with some embodiments of the present disclosure.
Figure 2B:
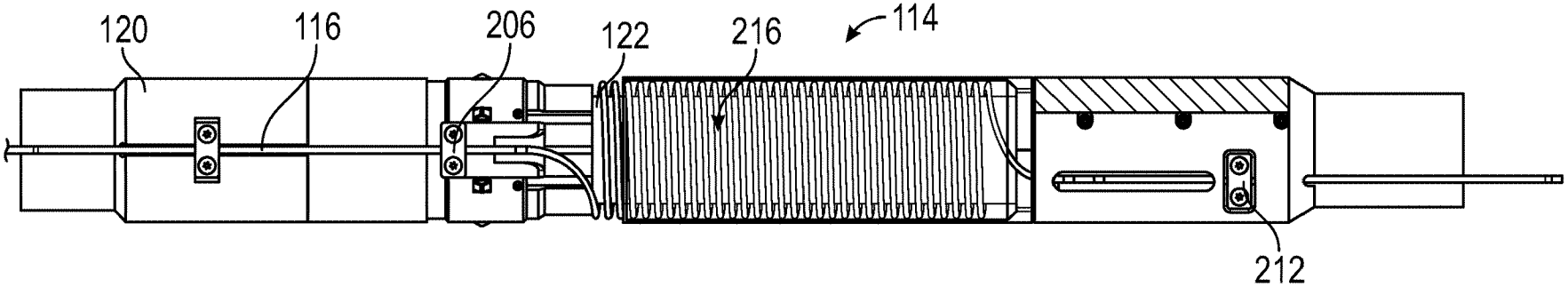

FIGS. 2A-B illustrate respective side views of the swivel sub apparatus 114, in accordance with some embodiments of the present disclosure. Specifically, FIGS. 2A-B illustrate the displaceability of the control line 116 in response to rotation of the spool mandrel 122 with respect to the connector sub 120. FIG. 2A discloses the swivel sub 114 with the spool mandrel 122 in a neutral position with respect to the connector sub 120. As illustrated, the control line 116 may be secured to the connector sub 120 via a first control line housing 200. The first control line housing 200 may be secured to a radially outer connector surface 202 of the connector sub 120. Further, the first control line housing 200 may include a bore configured to receive the control line 116. That is, the control line 116 may extend through the bore. As the first control line housing 200 is secured to the connector sub 120, an inner surface of the bore may restrain radial and circumferential movement of the control line 116 with respect to the connector sub 120. The first control line housing 200 may also be configured to clamp onto the control line 116 to further restrain axial movement of the control line 116 with respect to the first control line housing 200.

Moreover, the control line 116 may be secured to a retainer sub 204 via a second control line housing 206 secured to a radially outer retainer surface 208 of the retainer sub 204. As illustrated, the control line 116 extends from the first control line housing 200 on the connector sub 120 across to the second control line housing 206 on the retainer sub 204. The second control line housing 206 may include a second bore configured to receive the control line 116 such that the control line may extend through the second bore. The inner surface of the second bore may restrain radial and circumferential movement of the control line 116 with respect to the connector sub 120. The second control line housing 206 may also be configured to clamp onto the control line 116 to restrain axial movement of the control line 116 with respect to the second control line housing 206. As the retainer sub 204 is rotationally fixed with respect to the connector sub 120, the first control line housing 200 and the second control line housing 206 may maintain a fixed distance during rotation of the spool mandrel 122, such that restraining axial movement of the control line 116 at the first control line housing 200 and the second control line housing 206 may not strain the control line 116 as the spool mandrel 122 rotates.

Further, the control line 116 may be secured to a clamped mandrel 210 via a third control line housing 212 secured to a radially outer clamped surface 214 of the clamped mandrel 210. Alternatively, the control line housing 212 may be secured to another portion of the swivel sub (e.g., a lower connector mandrel 218) to secure the control line 116 proximate a downhole end 126 of the swivel sub 114. As illustrated, the clamped mandrel 210 may be disposed about a portion of the lower connector mandrel 218. Moreover, the third control line housing 212 may include a third bore configured to receive the control line 116 such that the control line 116 may extend through the third bore. The inner surface of the third bore may restrain radial and circumferential movement of the control line 116 with respect to the clamped mandrel 210 and/or the lower connector mandrel 218. Further, the third control line housing 212 may be configured to clamp onto the control line 116 to restrain axial movement of the control line 116 with respect to the clamped mandrel 210 and/or the lower connector mandrel 218.

As illustrated, the control line 116 extends from the second control line housing 206 on the retainer sub 204 across to the third control line housing 212 on the clamped mandrel 210 and/or the lower connector mandrel 218, which are disposed proximate a downhole end 126 of the swivel sub 114. The clamped mandrel 210 and/or the lower connector mandrel 218 may be rotationally fixed with respect to the spool mandrel 122. As such, rotation of the spool mandrel 122 may drive rotation of the clamped mandrel 210 and/or the lower connector mandrel 218 with respect to the connector sub 120 and the retainer sub 204, which may also rotate the angular position of the control line 116 with respect to the downhole tool 108 (shown in FIG. 1). That is, rotating the spool mandrel 122 may drive rotation of the clamped mandrel 210 and/or the lower connector mandrel 218 to rotate the mating end 124 of the control line 116 for aligning and mating with the corresponding connector 128 (shown in FIG. 1) of the downhole tool 108. Indeed, restraining axial movement of the control line 116 at the clamped mandrel 210 and/or the lower connector mandrel 218 may hold the mating end 124 of the control line 116 in a fixed angular position on the clamped mandrel 210 and/or the lower connector mandrel 218 at the downhole end 126 of the swivel sub 114 such that rotation of the spool mandrel 122 also rotates the angular position of the control line 116 with respect to the downhole tool 108.

Moreover, the distance between the second control line housing 206 and the third control line housing 212 may increase as the clamped mandrel 210 and/or the lower connector mandrel 218 rotates with respect to the connector sub 120 and the retainer sub 204 in response to rotation of the spool mandrel 122. As set forth above, the control line 116 extends from the second control line housing 206 on the connector sub 120 to the third control line housing 212 on the clamped mandrel 210 and/or the lower connector mandrel 218. However, the control line 116 may comprise a coiled portion 216 between the second control line housing 206 and the third control line housing 212 to accommodate the variable distance between the second control line housing 206 and the third control line housing 212. That is, the control line 116 may be coiled about the spool mandrel 122 (e.g., forming the coiled portion) between the second control line housing 206 and the third control line housing 212. The control line 116 may comprise a material that may be displaced (e.g., elastic deformation) without permanently straining (e.g., plastic deformation). As such, the coiled portion 216 of the control line 116 may be displaced (e.g., stretch, uncoil, recoil, etc.) in response to rotation of the spool mandrel 122 without permanently straining and damaging the control line 116. Further, increasing a number of coils or wraps of the coiled portion 216 about the spool mandrel 122 may increase a length of the control line 116 between the second control line housing 206 and the third control line housing 212. Increasing the length of the control line 116 may reduce strain on the control line 116 by spreading the deformation or displacement across a greater length. As such, the coiled portion 216 of the control line 116 may be advantageous for reducing strain on the control line 116 as the spool mandrel 122 rotates to vary the distance between the second control line housing 206 and the third control line housing 212.

FIG. 2B discloses the swivel sub apparatus 114 with the spool mandrel 122 in a rotated position with respect to the connector sub 120. In particular, the spool mandrel 122 is rotated counterclockwise with respect to the connector sub 120. Such rotation increases the distance between the second control line housing 206 and the third control line housing 212. As set forth above, the control line 116 is axially fixed at the second control line housing 206 and the third control line housing 212. As such, the coiled portion 216 of the control line 116 may be displaced (e.g., stretch, uncoil, etc.) to accommodate the increased distance between the second control line housing 206 and the third control line housing 212.

Moreover, rotating the spool mandrel 122 back to the neutral position may reduce the distance between the second control line housing 206 and the third control line housing 212. As such, the coiled portion 216 of the control line 116 may recoil and/or compress back to a neutral state to reduce slack in the control line 116 between the second control line housing 206 and the third control line housing 212. Such displacement of the coiled portion 216 may permit rotation of the spool mandrel 122 between the first angular position and the second angular position without permanently straining and damaging the control line 116.

Figure 3:
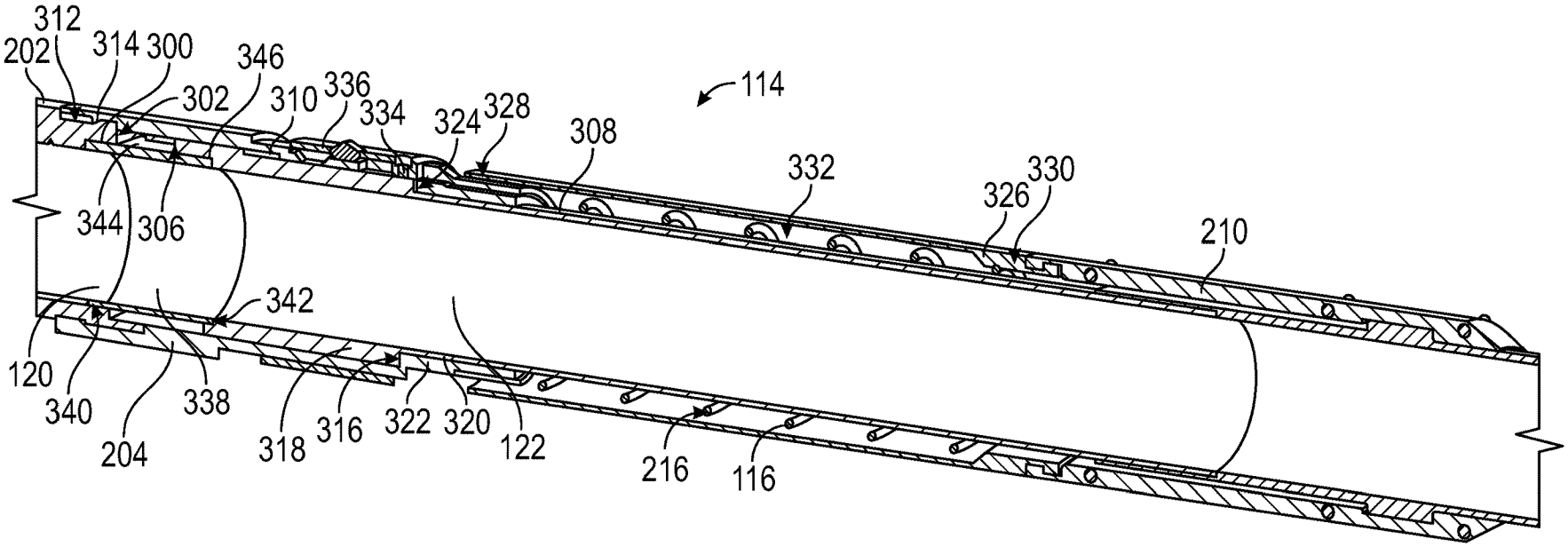
FIG. 3 illustrates a cross-sectional view of a swivel sub apparatus, in accordance with some embodiments of the present disclosure.

FIG. 3 illustrates a cross-sectional view of the swivel sub apparatus 114, in accordance with some embodiments of the present disclosure. The swivel sub 114 includes the connector sub 120 and the spool mandrel 122, which is rotatable with respect to the connector sub 120. The swivel sub further includes the intermediate sub 338 disposed between the connector sub 120 and the spool mandrel 122. The intermediate sub 338 may rotate independent of both the connector sub 120 and the spool mandrel 122. The spool mandrel 122 may rotate with respect to the connector sub 120 between the first angular position and the second angular position. The first angular position and the second angular position may be between six hundred and thirty to seven hundred and twenty degrees apart. However, the first angular position and the second angular position may be offset by any amount between zero to seven hundred and twenty degrees. As set forth in greater detail below, rotation of the intermediate sub 338 may permit the spool mandrel 122 to rotate more than one revolution, which may help facilitate reliable mating between the swivel sub 114 and the downhole tool 108 (shown in FIG. 1).

As illustrated, an uphole end 340 of the intermediate sub 338 may be at least partially disposed within the connector sub 120, and a downhole end 342 of the intermediate sub 338 may be at least partially disposed within the spool mandrel 122. Alternatively, the uphole end 340 of the intermediate sub 338 may be axially offset from the connector sub 120, and the downhole end 342 of the intermediate sub 338 may be axially offset from the spool mandrel 122. Further, in another alternative, the uphole end 340 of the intermediate sub 338 may be disposed about the connector sub 120 such that the connector sub 120 is disposed at least partially within the intermediate sub 338, and the downhole end 342 of the intermediate sub 338 may be disposed about the spool mandrel 122 such that the spool mandrel 122 is disposed at least partially within the intermediate sub 338. Moreover, the connector sub 120, the intermediate sub 338, and the spool mandrel 122 each comprise a substantially tubular shape (e.g., a substantially hollow cylindrical shape). As illustrated, a radially inner connector surface 300 of a downhole end 302 of the connector sub 120 may have a greater diameter than a radially outer intermediate surface 344 of the uphole end 340 of the intermediate sub 338, such that the uphole end 340 of the intermediate sub 338 may be disposed in the downhole end 302 of the connector sub 120. Having the uphole end 340 of the intermediate sub 338 disposed in the downhole end 302 of the connector sub 120 may restrain radial movement of the intermediate sub 338 with respect to the connector sub 120. Further, a radially inner mandrel surface 346 of an uphole end 306 of the spool mandrel 122 may have a greater diameter than the radially outer intermediate surface 344 of the downhole end 342 of the intermediate sub 338, such that the downhole end 342 of the intermediate sub 338 may be disposed in the uphole end 306 of the spool mandrel 122. Having the downhole end 342 of the intermediate sub 338 disposed in the uphole end 306 of the spool mandrel 122 may restrain radial movement of the intermediate sub 338 with respect to the spool mandrel 122. Alternatively, or additionally, the swivel sub 114 may include the retainer sub 204 for restraining radial movement of the connector sub 120, the intermediate sub 338, and/or the spool mandrel 122.

Moreover, the swivel sub 114 may include the retainer sub 204 for restraining axial movement between the spool mandrel 122, the intermediate sub 338, and the connector sub 120. As illustrated, the retainer sub 204 may be disposed radially exterior to the connector sub 120, the intermediate sub 338, and the spool mandrel 122. The connector sub 120 and the spool mandrel 122 may each include slots and or shoulders formed in their respective radially outer surfaces (e.g., the radially outer connector surface 202 and a radially outer spool surface 308). The retainer sub 204 may include corresponding features formed in a radially inner retainer surface 310 of the retainer sub 204 for interfacing with the slots and/or shoulders formed in connector sub 120 and spool mandrel 122. Such interfaces may restrain axial movement of the spool mandrel 122 with respect to the connector sub 120. Further, as the intermediate sub 338 is disposed between the connector sub 120 and the spool mandrel 122, restraining axial movement of the connector sub 120 and the spool mandrel 122 may restrain axial movement of the intermediate sub 338.

For example, as illustrated, the connector sub 120 may include an outer connector slot 312 formed in the radially outer connector surface 202 of the connector sub 120. The outer connector slot 312 may at least partially extend about the circumference of the connector sub 120. The retainer sub 204 may include a corresponding retainer protrusion 314 extending radially inward from the radially inner retainer surface 310 of the retainer sub 204. The retainer protrusion 314 may at least partially extend about the circumference of the radially inner retainer surface 310. The retainer protrusion 314 may be disposed within the outer connector slot 312 and contact between the retainer protrusion 314 and the outer connector slot 312 may restrain axial movement of the connector sub 120 with respect to the retainer sub 204. Further, the swivel sub 114 may include additional fasteners and/or interfaces between the connector sub 120 and the retainer sub 204 to rigidly secure the connector sub 120 to the retainer sub 204 (i.e., to restrain axial, radial, and rotational movement between the connector sub 120 and the retainer sub 204).

Moreover, the spool mandrel 122 may include a spool shoulder 316 formed at a transition between a protruding portion 318 of the spool mandrel 122 and a base portion 320 of the spool mandrel 122. The protruding portion 318 may have a larger diameter than the base portion 320 such that the spool shoulder 316 is formed at the transition. As illustrated, the retainer sub 204 may include a radially inner lip 322 formed in the radially inner retainer surface 310 of the retainer sub 204. An uphole end 324 of the radially inner lip 322 may interface with the spool shoulder 316 to restrain downhole movement of the spool mandrel 122 with respect to the retainer sub 204 and the connector sub 120. Additionally, uphole movement of the spool mandrel 122 with respect to the retainer sub 204 and the connector sub 120 may be restrained by an interface between the uphole end 306 of the spool mandrel 122 and the downhole end 342 of the intermediate sub 338, which is restrained by contact between the uphole end 340 of the intermediate sub 338 and the downhole end 302 of the connector sub 120. As such, axial movement between the spool mandrel 122, the intermediate sub 338, and the connector sub 120 may be restrained.

Additionally, a shroud 326 may be disposed about the coiled portion 216 of the control line 116. An uphole end 328 of the shroud 326 may be secured to the retainer sub 204, and a downhole end 330 of the shroud 326 may be secured to the clamped mandrel 210. Further, the shroud 326 may be radially offset from the spool mandrel 122 such that a control line cavity 332 is formed between the spool mandrel 122 and the shroud 326 for housing the coiled portion 216 of the control line 116. The shroud 326 may shield the coiled portion 216 of the control line 116 from the downhole environment.

Moreover, as set forth above, the spool mandrel 122 may freely rotate with respect to the connector sub 120 between the first angular position and the second angular position. However, as the swivel sub 114 is run-in-hole, rotation of the spool mandrel 122 with respect to the connector sub 120 may be undesirable. As such, the swivel sub 114 may include a shear member 334 (e.g., shear pin or other suitable fastener) configured to restrain rotation of the spool mandrel 122 with respect to the connector sub 120. The shear member 334 may initially hold the spool mandrel 122 in a neutral position between the first and second angular position. However, once the swivel sub 114 is positioned proximate the downhole tool 108, rotation of the spool mandrel 122 may be needed to re-orient the control line 116 with respect to the corresponding connector 128 of the downhole tool 108. As such, the swivel sub 114 may include a shear mechanism 336 to shear the shear member 334, which releases the spool mandrel 122 to rotate with respect to the connector sub 120. As set forth in greater detail below, the shear mechanism 336 may be configured to actuate in response to the shear mechanism 336 contacting the downhole tool 108 (shown in FIG. 1). Such contact may apply a threshold force needed for shearing the shear member 334.

Figure 4:
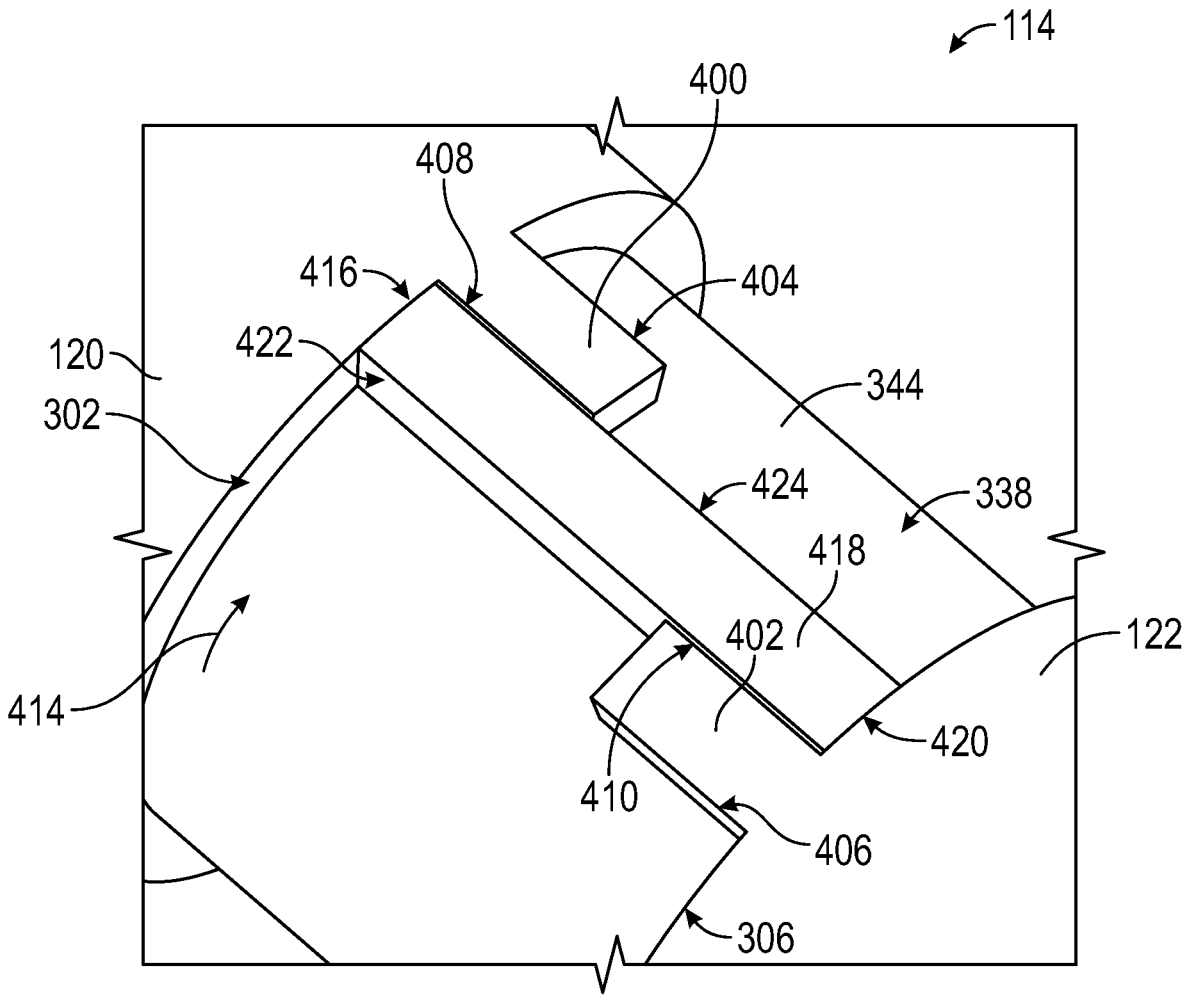
FIG. 4 illustrates a side view of a connector sub, an intermediate sub, and a spool mandrel of a swivel sub apparatus, in accordance with some embodiments of the present disclosure.

FIG. 4 illustrates a side view of the connector sub 120, the intermediate sub 338, and the spool mandrel 122 of the swivel sub apparatus 114, in accordance with some embodiments of the present disclosure. The connector sub 120 may include a connector lug 400. As illustrated, the connector lug 400 may comprise an axially extending connector lug 400 that may extend axially outward from the downhole end 302 of the connector sub 120. However, the connector lug 400 may comprise any suitable shape and/or orientation. Moreover, the spool mandrel 122 may include a mandrel lug 402. The mandrel lug 402 may comprise an axially extending mandrel lug 402 that may extend axially outward from the uphole end 306 of the spool mandrel 122. However, the mandrel lug 402 may also comprise any suitable shape and/or orientation. As set forth above, the downhole end 302 of the connector sub 120 may be spaced apart axially from the uphole end 306 of the spool mandrel 122 to form a gap between the connector sub 120 and the spool mandrel 122 for the intermediate sub 338.

Further, the connector lug 400 and the mandrel lug 402 may also be spaced apart axially to form a gap between the connector lug 400 and the mandrel lug 402 such that the mandrel lug 402 may not contact the connector lug 400 during rotation of the spool mandrel 122. Instead, the connector lug 400 interfaces with an uphole end 416 of an intermediate lug 418 of the intermediate sub 338, and the mandrel lug 402 interfaces with a downhole end 420 of the intermediate lug 418. As illustrated, the intermediate sub 338 is disposed between the connector sub 120 and the spool mandrel 122, and the intermediate sub 338 includes the intermediate lug 418 extending radially outward from the radially outer intermediate surface 344 of the intermediate sub 338.

Additionally, the intermediate lug may extend axially between the downhole end 302 of the connector sub 120 and the uphole end 306 of the spool mandrel 122. In particular, as illustrated, the uphole end 416 of the intermediate lug 418 may extend to the downhole end 302 of the connector sub 120. Alternatively, the intermediate lug 418 may be offset from the downhole end 302 of the connector sub 120, but may extend toward the downhole end 302 such that the intermediate lug 418 is axially aligned with at least a portion of the connector lug 400. Further, as illustrated, the downhole end 420 of the intermediate lug 418 may extend to the uphole end 306 of the spool mandrel 122. Alternatively, the intermediate lug 418 may be offset from the uphole end 306 of the spool mandrel 122, but may extend toward the uphole end 306 such that the intermediate lug 418 is axially aligned with at least a portion of the mandrel lug 402.

Having the intermediate lug 418 axially aligned with at least a portion of the connector lug 400 may cause the intermediate lug 418 to contact the connector lug 400 at a particular angular orientation during rotation of the spool mandrel 122, which may restrain rotation of the intermediate sub 338 with respect to the connector sub 120. Additionally, having the intermediate lug 418 axially aligned with at least a portion of the mandrel lug 402 may cause the intermediate lug 418 to contact the mandrel lug 402 at a particular angular orientation during rotation of the spool mandrel 122, which may restrain rotation of the intermediate sub 338 with respect to the spool mandrel 122. Indeed, contact between the intermediate lug 418, the connector lug 400, and the mandrel lug 402 bounds rotational movement of the spool mandrel 122 with respect to the connector sub 120 between a first angular position and a second angular position.

In the first angular position of the spool mandrel 122, a first side 404 of the connector lug 400 is disposed proximate a first side 422 of the intermediate lug 418 and a first side 406 of the mandrel lug 402 is disposed proximate a second side 424 of the intermediate lug 418. The swivel sub 114 may be run-in-hole with the spool mandrel 122 in the first angular position. However, in response to contact with the downhole tool 108 (shown in FIG. 1), the spool mandrel 122 may rotate from the first angular position toward the second angular position in a first direction 414 (e.g., a clockwise direction). In particular, as the spool mandrel 122 rotates in the first direction 414, the mandrel lug 402 rotates away from the second side 424 of the intermediate lug 418 toward the first side 422 of the intermediate lug 418. Further, continued rotation of the spool mandrel 122 may drive a second side 410 of the mandrel lug 402 into the first side 422 of the intermediate lug 418, which may drive the intermediate lug 418 away from the first side 404 of the connector lug 400 toward the second side 408 of the connector lug 400. Moreover, contact between the second side 410 of the mandrel lug 402 with the first side 422 of the intermediate lug 418 and contact between the second side 424 of the intermediate lug 418 and the second side 408 of the connector lug 400 may restrain rotational movement of the spool mandrel 122 with respect to the connector sub 120 at the second angular position. In the illustrated embodiment, the spool mandrel 122 is disposed in the second angular position.

FIGS. 5A-E illustrate respective cross-sectional views of the connector lug 400 of the connector sub 120, the intermediate lug 418 of the intermediate sub 338, and the mandrel lug 402 of the spool mandrel 122, in accordance with some embodiments of the present disclosure. In particular, FIG. 5A discloses the mandrel lug 402 disposed in the first angular position 500 with respect to the connector lug 400 of the connector sub 120. In the first angular position 500, the first side 404 of the connector lug 400 is disposed proximate the first side 422 of the intermediate lug 418 and the first side 406 of the mandrel lug 402 is disposed proximate the second side 424 of the intermediate lug 418. The spool mandrel 122 may be bounded in the second direction 502 (e.g., the counterclockwise direction) at the first angular position 500 by contact between the first side 404 of the connector lug 400 and the first side 422 of the intermediate lug 418, as well as the contact between the first side 406 of the mandrel lug 402 and the second side 424 of the intermediate lug 418. As set forth above, restraining angular movement of the spool mandrel 122 with respect to the connector sub 120 may prevent over-rotation of the spool mandrel 122 and avoid strain and damage to the control line 116 (shown in FIGS. 2A-B).

Figure 5C:
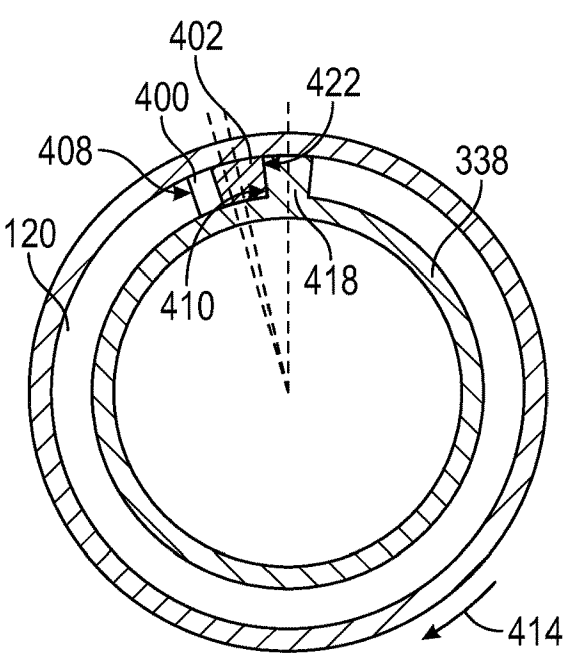
FIGS. 5A-E illustrate respective cross-sectional views of a connector lug of a connector sub, an intermediate lug of an intermediate sub, and a mandrel lug of a spool mandrel, in accordance with some embodiments of the present disclosure.
Figure 5B:
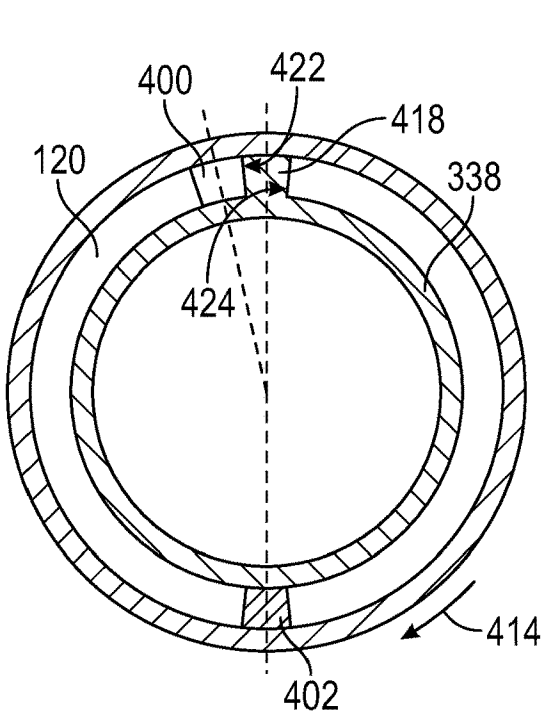
Figure 5A:
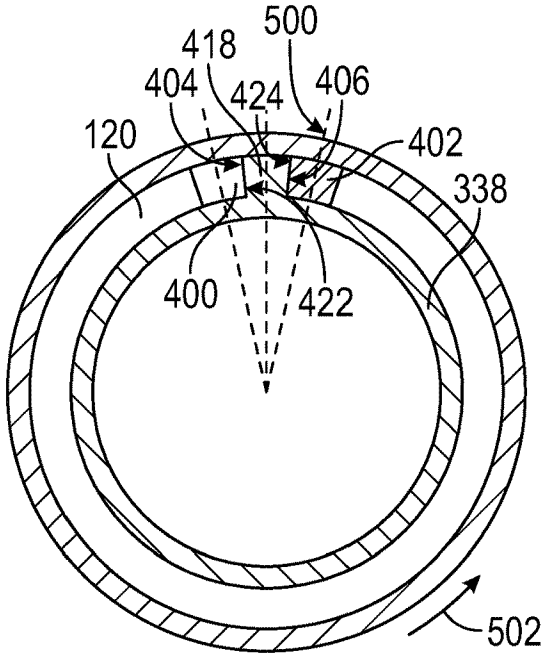

FIG. 5B discloses the mandrel lug 402 having moved in the first direction 414 (e.g., the clockwise direction) away from the intermediate lug 418. As the spool mandrel 122 rotates in the first direction 414, the mandrel lug 402 rotates away from the second side 424 of the intermediate lug 418 toward the first side 422 of the intermediate lug 418. Additionally, the mandrel lug 402 rotates independent of the intermediate lug 418 and the connector lug 400. As such, the intermediate lug 418 may remain positioned proximate the connector lug 400 as the mandrel lug 402 moves in the first direction 414 from the first angular position 500 (shown in FIG. 5A).

FIG. 5C discloses the mandrel lug 402 positioned proximate the first side 422 of the intermediate lug 418. As illustrated, continued rotation of the spool mandrel 122 in the first direction 414 drives the second side 410 of the mandrel lug 402 into the first side 422 of the intermediate lug 418, which may drive the intermediate lug 418 in the first direction 414 away from the first side of the connector lug 400 toward the second side 408 of the connector lug 400. Moreover, as the mandrel lug 402 is axially offset or spaced apart from the connector lug 400, the mandrel lug 402 may continue to rotate past the connector lug 400 as the spool mandrel 122 rotates in the first direction 414.

Figure 5E:
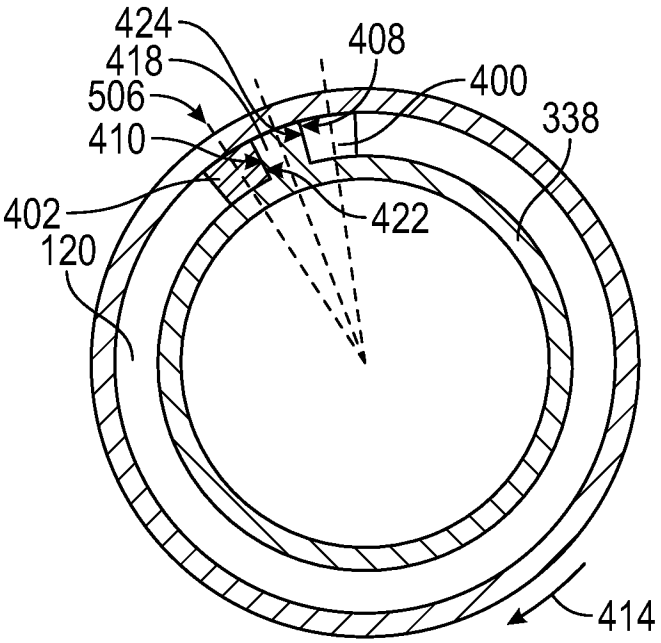
Figure 5D:
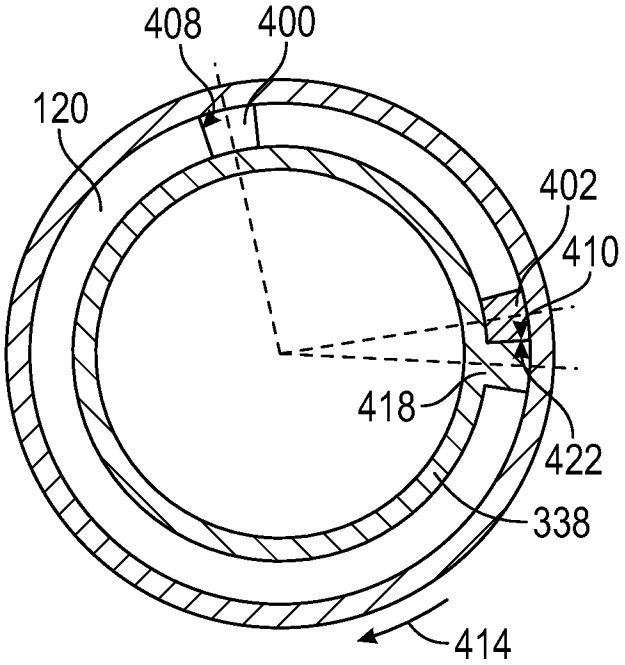

FIG. 5D discloses the mandrel lug 402 driving the intermediate lug 418 in the first direction 414 away from the connector lug 400. Indeed, contact between the second side 410 of the mandrel lug 402 into the first side 422 of the intermediate lug 418 may allow rotation of the spool mandrel 122 to drive both the mandrel lug 402 and the intermediate lug 418 in the first direction 414 towards the second side 408 of the connector lug 400.

FIG. 5E discloses the mandrel lug 402 disposed in the second angular position 506. Moreover, in the second angular position 506, the second side 424 of the intermediate lug 418 is in contact with the second side 408 of the connector lug 400 and the second side 410 of the mandrel lug 402 is in contact with the first side 422 of the intermediate lug 418. Contact between the second side 410 of the mandrel lug 402 and the first side 422 of the intermediate lug 418, as well as contact between the second side 424 of the intermediate lug 418 and the second side 408 of the connector lug 400 may restrain rotational movement of the spool mandrel 122 in the first direction 414 (e.g., the clockwise direction) with respect to the connector sub 120 at the second angular position 506.

Moreover, the first angular position 500 (shown in FIG. 5A) and the second angular position 506 may be between six hundred and thirty degrees to seven hundred and twenty degrees apart. As such, the spool mandrel 122 may freely rotate six hundred and thirty degrees to seven hundred and twenty degrees between the first angular position 500 and the second angular position 506 in response to contact of the swivel sub 114 with the downhole tool 108 to align the mating end 124 of the control line 116 with the corresponding connector 128 of the downhole tool 108 (shown in FIG. 1).

Figure 6:
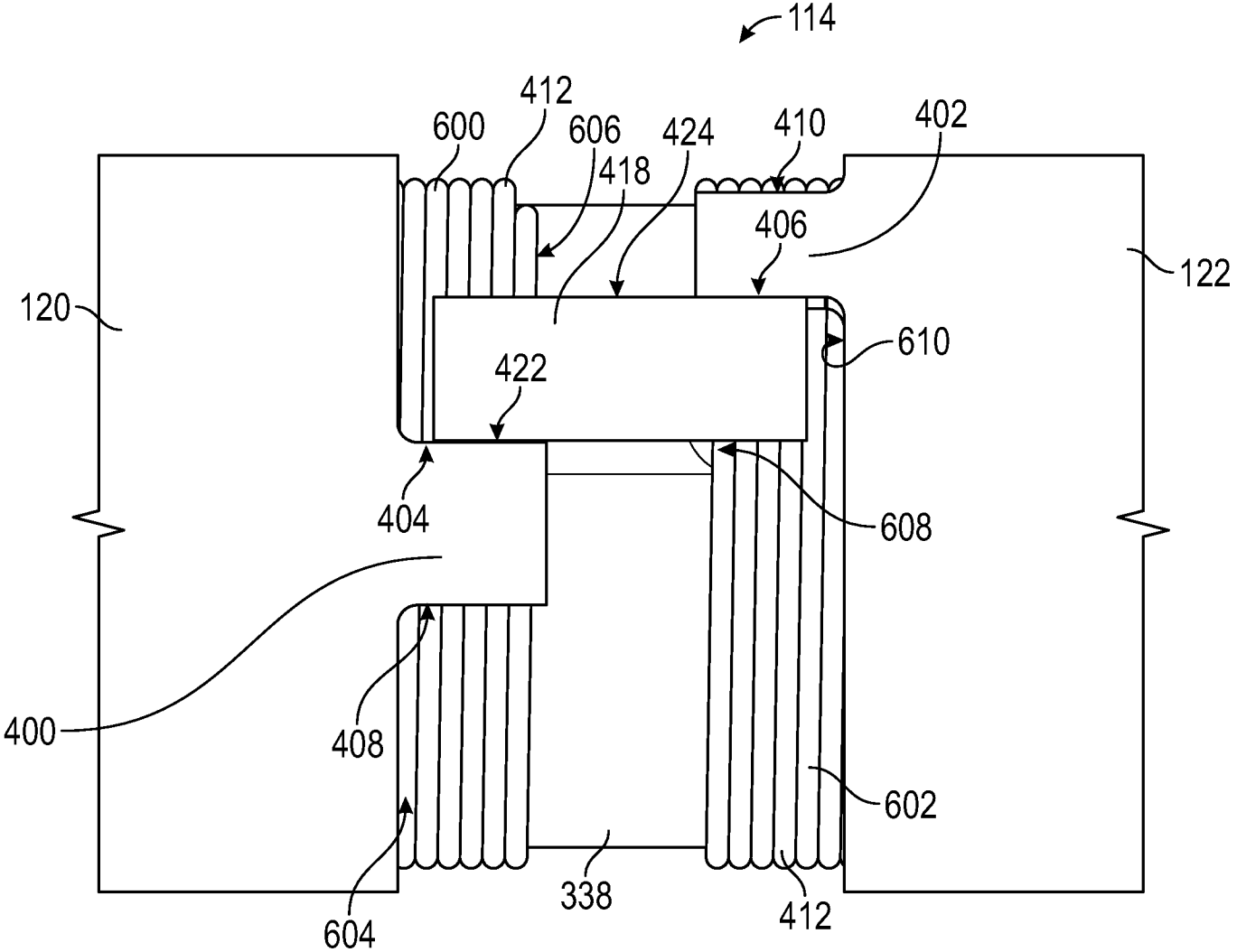
FIG. 6 illustrates a side view of a swivel sub apparatus having a return spring, in accordance with some embodiments of the present disclosure.

FIG. 6 illustrates a side view of a swivel sub 114 having at least one return spring 412, in accordance with some embodiments of the present disclosure. As set forth above, the at least one return spring 412 may be configured to bias the spool mandrel 122 toward an initial angular position and/or neutral position of the spool mandrel 122 with respect to the connector sub 120. For example, the initial angular position of the spool mandrel 122 may be the first angular position 500 (e.g., shown in FIG. 5A). As such, the at least one return spring 412 may bias the spool mandrel 122 toward the first angular position 500 of the spool mandrel 122 in response to the spool mandrel 122 rotating toward the second angular position 506 (e.g., in the clockwise direction or the counterclockwise direction). Further, the at least one return spring 412 may comprise a compression spring, a tension spring, a torsion spring, or some combination thereof.

Moreover, as illustrated, the at least one return spring 412 may comprise a first return spring 600 and a second return spring 602. A first end 604 of the first return spring 600 may be attached to the connector sub 120 and a second end 606 of the first return spring 600 may be attached to the intermediate sub 338. In particular, the second end 606 of the first return spring 600 may be attached to the intermediate lug 418 of the intermediate sub 338. Further, a first end 608 of the second return spring 602 may be attached to the intermediate sub 338 and a second end 610 of the second return spring 602 may be attached to the spool mandrel 122. In particular, the first end 608 of the second return spring 602 may be attached to the intermediate lug 418 of the intermediate sub 338. As illustrated, the first return spring 600 and the second return spring 602 may comprise torsion springs configured to bias the spool mandrel 122 toward the initial angular position and/or neutral position of the spool mandrel 122.

As set forth above, in the neutral position, the first side 404 of the connector lug 400 is disposed proximate the first side 422 of the intermediate lug 418 and the first side 406 of the mandrel lug 402 is disposed proximate the second side 424 of the intermediate lug 418. Rotation of the mandrel lug 402 of the spool mandrel 122 away from the neutral position (e.g., in the clockwise direction) may strain the second return spring 602, such that the second return spring 602 may bias the mandrel lug 402 back toward the intermediate lug 418. Further, as set forth above, continued rotation of the spool mandrel 122 in the clockwise direction may drive the second side 410 of the mandrel lug 402 into the first side 422 of the intermediate lug 418, which may drive the intermediate lug 418 in the clockwise direction away from the first side 404 of the connector lug 400 and toward the second side 408 of the connector lug 400. Rotation of the intermediate lug 418 away from the connector lug 400 may strain the first return spring 600, such that the first return spring 600 may bias the intermediate lug 418 back toward connector lug 400. Accordingly, the first return spring 600 biasing the intermediate lug 418 toward the connector lug 400 and the second return spring 602 biasing the mandrel lug 402 toward the intermediate lug 418 may, in combination, bias the spool mandrel 122 toward the initial angular position and/or neutral position of the spool mandrel 122.

Figure 7:
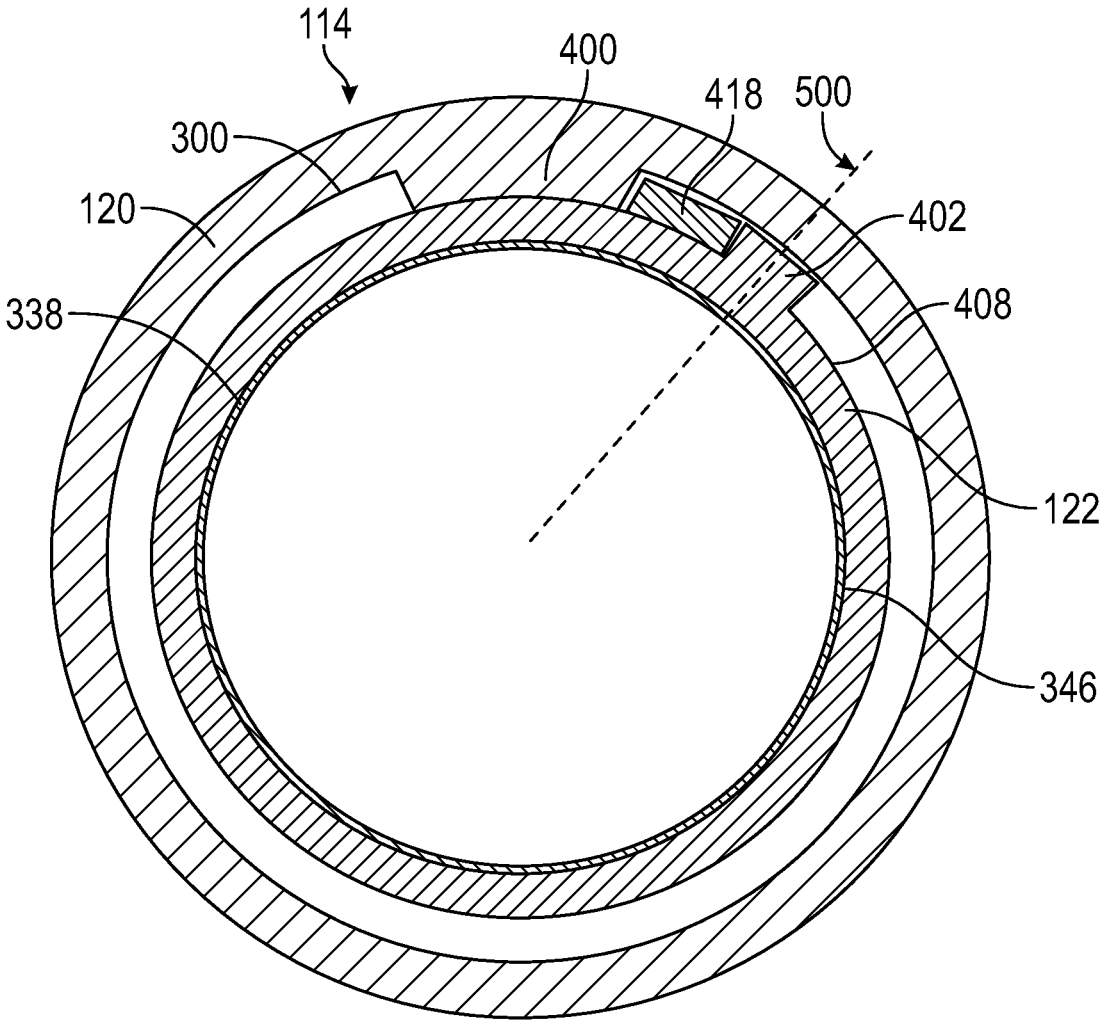
FIG. 7 illustrates a cross-sectional view of a radially extending connector lug, a radially extending mandrel lug, and an intermediate lug, in accordance with some embodiments of the present disclosure.

FIG. 7 illustrates a cross-sectional view of a radially extending connector lug 400, a radially extending mandrel lug 402, and the intermediate lug 418, in accordance with some embodiments of the present disclosure. As illustrated, the swivel sub 114 has the mandrel lug 402 disposed in the first angular position 500. Further, the connector lug 400 may extend radially inward from the radially inner connector surface 300 of the connector sub 120. Further, the mandrel lug 402 may extend radially outward from the radially outer spool surface 308 of the spool mandrel 122. Alternatively, the mandrel lug 402 may extend radially inward from the radially inner mandrel surface 346 of the spool mandrel 122. Additionally, the intermediate lug 418 may extend radially outward from the radially outer intermediate surface 344 (not shown) of the intermediate sub 338. Having radially extending lugs (e.g., the connector lug 400 and the mandrel lug 402) may be advantageous for reducing a length of the swivel sub 114 as having lugs extend axially outward from respective ends of the connector sub 120 and the spool mandrel 122 may not be needed.

Figure 8A:
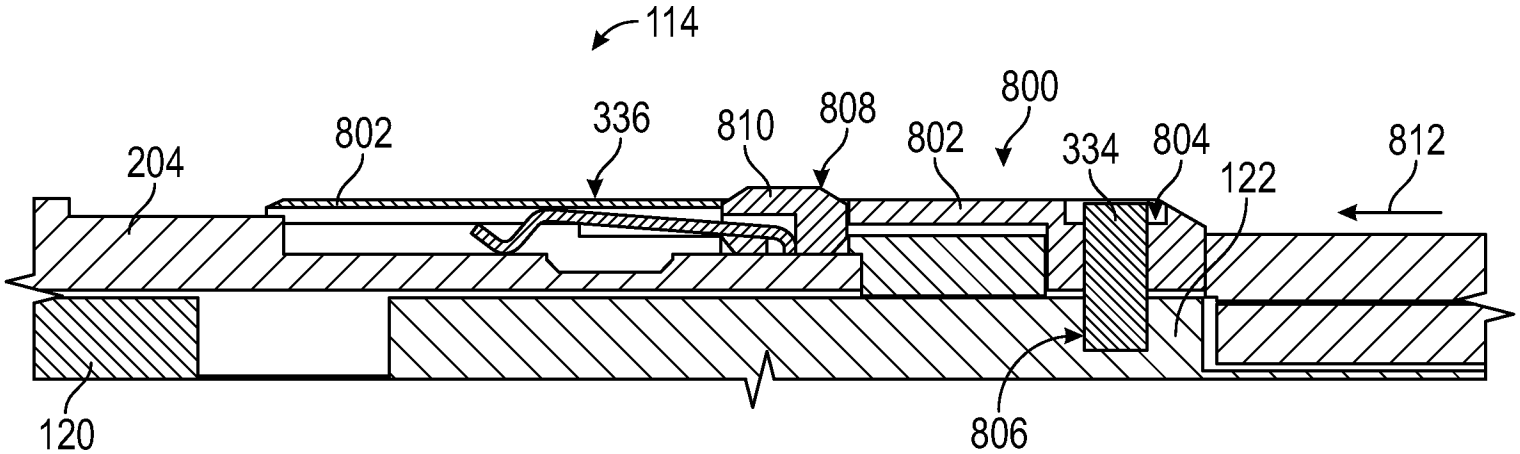
FIGS. 8A-B illustrate respective cross-sectional views of a shear mechanism, in accordance with some embodiments of the present disclosure.
Figure 8B:
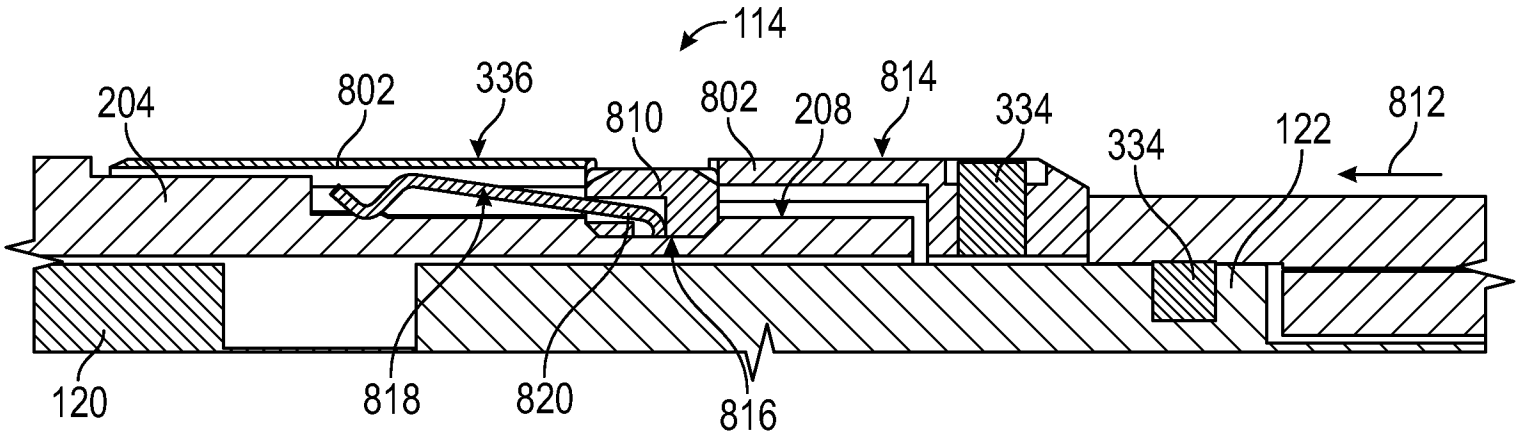

FIGS. 8A-B illustrate respective cross-sectional views of a shear mechanism, in accordance with some embodiments of the present disclosure. In particular, FIG. 8A discloses the shear mechanism 336 and the shear member 334 (e.g., shear pin) holding the spool mandrel 122 in a run-in position (e.g., a position of the spool mandrel 122 while being run-in-hole). As set forth above, the retainer sub 204 may be rigidly secured to the connector sub 120 such that the retainer sub 204 is axially and rotationally fixed with respect to the connector sub 120. Further, the shear mechanism 336 may be secured to the retainer sub 204 in a first axial position 800. The shear mechanism 336 may comprise a sleeve 802 having a shear member slot 804. As illustrated, the shear member 334 may be disposed in the shear member slot 804 to hold the spool mandrel 122 in the run-in position as the swivel sub 114 is run-in-hole. That is, the shear member 334 may extend through the shear member slot 804 and into a spool slot 806 formed in the spool mandrel 122. As such, the shear member 334 may restrain rotational movement, as well as axial movement, between the shear mechanism 336 and the spool mandrel 122, which may restrain rotational movement between the spool mandrel 122 and the connector sub 120.

The shear mechanism 336 may further comprise an interface feature 808 configured to engage (e.g., contact) the downhole tool 108 as the conveyance 118 drives the swivel sub 114 into the downhole tool 108 (shown in FIG. 1). As set forth above, the shear member 334 may restrain axial movement of the sleeve 802 of the shear mechanism 336 with respect to the spool mandrel 122. The interface feature 808 may include a protrusion (e.g., retractable interface pin 810) extending radially outward from the sleeve 802. Indeed, the retractable interface pin 810 may be disposed in a radially extended position as the swivel sub 114 is run-in-hole. As the retractable interface pin 810 engages the downhole tool 108, a force on retractable interface pin 810 may drive the sleeve 802 in the axially uphole direction 812 with respect to the spool mandrel 122. The shear member 334 may restrain axial movement of the sleeve 802 with respect to the spool mandrel 122. However, in response to at least a threshold force being applied to the retractable interface pin 810 from the engagement of the retractable interface pin 810 with the downhole tool 108, the sleeve 802 may shear the shear member 334 and slide in the axially uphole direction 812. As such, the shear mechanism 336 may be configured to shear the shear member 334 in response to the swivel sub apparatus 114 engaging a downhole tool 108 disposed in the wellbore 104 (shown in FIG. 1).

FIG. 8B discloses the shear mechanism 336 disposed in a locked position 814 (e.g., a second axial position) after sliding in the axially uphole direction 812 in response to the shear member 334 being sheared. As set forth above, the interface feature (e.g., retractable interface pin 810) is disposed in the radially extended position as the swivel sub 114 is run-in-hole. Specifically, the radially outer retainer surface 208 of the retainer sub 204 may bias the retractable interface pin 810 toward the radially extended position in the run-in position. However, in the locked position 814, the retractable interface pin 810 may be axially aligned with a corresponding interface feature slot 816 formed in the retainer sub 204. The retractable interface pin 810 is configured to retract into the interface feature slot 816 as the shear mechanism 336 slides to the locked position 814. The retractable interface pin 810 may cease to engage the downhole tool 108 once retracted such that the shear mechanism 336 avoids interfering with rotation of the spool mandrel 122 with respect to the downhole tool 108 as the mating end 124 of the control line 116 is re-oriented to mate with the corresponding connector 128 of the downhole tool 108 (shown in FIG. 1).

Moreover, the shear mechanism 336 may further include a locking mechanism 818 configured to secure the shear mechanism 336 in the locked position 814. As illustrated, the locking mechanism 818 may include a biasing arm 820 connected to the retractable interface pin 810. The biasing arm 820 may be configured to bias the retractable interface pin 810 radially inward to hold the retractable interface pin 810 in the interface feature slot 816 in the locked position 814. Further, contact between axial surfaces of the retractable interface pin 810 and the interface feature slot 816 may restrain axial movement of the retractable interface pin 810, which also restrains axial movement of the sleeve 802 to hold the shear mechanism 336 in the locked position 814. Although, a particular shear mechanism 336 is shown in the illustrated embodiment, the swivel sub 114 may include any suitable shear mechanism to shear the shear member 334 and release to spool mandrel 122 to rotate with respect to the connector sub 120 in response to engagement of the swivel sub 114 with the downhole tool 108.

Accordingly, the present disclosure may provide a swivel sub having a spool mandrel configured to rotate with respect to a connector sub, between a first angular position and a second angular position bounded by a connector lug, a mandrel lug, and an intermediate lug, to align a mating end of a control line with a corresponding connector of a downhole tool while avoiding straining and damaging the control line. The methods and systems may include any of the various features disclosed herein, including one or more of the following statements.

Statement 1. An apparatus, comprising: a connector sub rigidly securable to a conveyance for running the connector sub along a wellbore, the connector sub having a connector lug; a spool mandrel having a mandrel lug, wherein the spool mandrel is rotatable with respect to the connector sub; and an intermediate sub disposed between the connector sub and the spool mandrel, wherein the intermediate sub includes an intermediate lug extending outward from an outer surface of the intermediate sub, and wherein contact between the intermediate lug, the connector lug, and the mandrel lug bounds rotational movement of the spool mandrel with respect to the connector sub between a first angular position and a second angular position.

Statement 2. The apparatus of statement 1, wherein a first side of the connector lug is disposed proximate a first side of the intermediate lug and a first side of the mandrel lug is disposed proximate a second side of the intermediate lug in the first angular position of the spool mandrel.

Statement 3. The apparatus of statement 1 or statement 2, wherein the mandrel lug is configured to rotate away from the second side of the intermediate lug toward the first side of the intermediate lug in response to rotation of the spool mandrel in a first rotational direction, and wherein a second side of the mandrel lug contacts the first side of the intermediate lug to drive the intermediate lug away from the first side of the connector lug toward the second side of the connector lug in response to further rotation of the spool mandrel in the first rotational direction.

Statement 4. The apparatus of any preceding statement, wherein contact between the second side of the mandrel lug with the first side of the intermediate lug and contact between the second side of the intermediate lug and the second side of the connector lug bounds rotational movement of the spool mandrel with respect to the connector sub at the second angular position.

Statement 5. The apparatus of any preceding statement, wherein the connector lug and the mandrel lug are spaced apart axially to form a gap between the connector lug and the mandrel lug.

Statement 6. The apparatus of any preceding statement, wherein the connector lug interfaces with an uphole axial end of the intermediate lug, and wherein the mandrel lug interfaces with a downhole axial end of the intermediate lug.

Statement 7. The apparatus of any preceding statement, wherein the first angular position and the second angular position are between 630 to 720 degrees apart.

Statement 8. The apparatus of any preceding statement, further comprising a retainer sub disposed radially exterior to the connector sub and the spool mandrel, wherein the retainer sub restrains axial movement of the spool mandrel with respect to the connector sub to couple the spool mandrel to the connector sub.

Statement 9. The apparatus of any preceding statement, further comprising a shear pin and a shear mechanism, wherein the shear pin restrains rotational movement of the spool mandrel with respect to the connector sub as the apparatus is run-in-hole, and wherein the shear mechanism is configured to shear the shear pin in response to the apparatus engaging a downhole tool disposed in the wellbore.

Statement 10. The apparatus of any preceding statement, wherein the shear mechanism comprises a sleeve having a shear pin slot and an interface feature configured to engage the downhole tool, wherein the shear pin is disposed in the shear pin slot as the apparatus is run-in-hole, and wherein the sleeve is configured to slide axially to shear the shear pin in response to the interface feature engaging the downhole tool.

Statement 11. The apparatus of any preceding statement, wherein the interface feature comprises a protrusion extending radially outward from the sleeve, wherein the sleeve is configured to slide axially to shear the shear pin in response to the protrusion engaging the downhole tool.

Statement 12. The apparatus of any preceding statement, wherein the interface feature comprises a retractable interface pin, wherein the retractable interface pin is in a radially extended position as the apparatus is run-in-hole, and wherein the sleeve is configured to slide axially to shear the shear pin in response to the retractable interface pin engaging the downhole tool.

Statement 13. The apparatus of any preceding statement, wherein the sleeve of the shear mechanism is slidable from a first axial position to a second axial position in response to the shear pin shearing, wherein the retractable interface pin is configured to retract into a corresponding slot formed in a retainer sub in the second axial position.

Statement 14. The apparatus of any preceding statement, wherein the shear mechanism further comprises a locking mechanism configured to secure the sleeve in a locked position that is axially offset from the first position with the shear pin.

Statement 15. An apparatus, comprising: a connector sub rigidly securable to a conveyance for running the connector sub along a wellbore, the connector sub having an axially extending connector lug; a spool mandrel having an axially extending mandrel lug, wherein the spool mandrel is rotatable with respect to the connector sub; an intermediate sub disposed between the connector sub and the spool mandrel, wherein the intermediate sub includes an intermediate lug extending radially outward from an outer surface of the intermediate sub, and wherein contact between the intermediate lug, the connector lug, and the mandrel lug bounds rotational movement of the spool mandrel with respect to the connector sub between a first angular position and a second angular position; at least one return spring configured to bias the spool mandrel to rotate toward an initial angular position of the spool mandrel with respect to the connector sub; and a control line extending between the connector sub and the spool mandrel, wherein the control line is displaceable to permit rotation of the spool mandrel with respect to the connector sub.

Statement 16. The apparatus of statement 15, wherein the at least one return spring is configured to bias the spool mandrel to rotate toward the first angular position of the spool mandrel with respect to the connector sub.

Statement 17. The apparatus of statement 15 or statement 16, wherein the at least one return spring comprises a first return spring and a second return spring, wherein a first end of the first return spring is attached to the spool mandrel and a second end of the first return spring is attached to the intermediate sub, and wherein and a first end of the second return spring is attached to the intermediate sub and a second end of the second return spring is attached to the connector sub.

Statement 18. The apparatus of any of statements 15-17, wherein the at least one return spring comprises a compression spring, a tension spring, a torsion spring, or some combination thereof.

Statement 19. An apparatus, comprising: a connector sub rigidly securable to a conveyance for running the connector sub along a wellbore, the connector sub having an axially extending connector lug; a spool mandrel having an axially extending mandrel lug, wherein the spool mandrel is rotatable with respect to the connector sub; an intermediate sub disposed between the connector sub and the spool mandrel, wherein the intermediate sub includes an intermediate lug extending radially outward from an outer surface of the intermediate sub, and wherein contact between the intermediate lug, the connector lug, and the mandrel lug bounds rotational movement of the spool mandrel with respect to the connector sub between a first angular position and a second angular position; a return spring configured to bias the spool mandrel to rotate toward an initial angular position of the spool mandrel with respect to the connector sub; and a control line extending between the connector sub and the spool mandrel, wherein the control line is displaceable to permit rotation of the spool mandrel with respect to the connector sub; a retainer sub disposed radially exterior to the connector sub and the spool mandrel, wherein the retainer sub restrains axial movement of the spool mandrel with respect to the connector sub; a shear pin for restraining rotational movement of the spool mandrel with respect to the connector sub as the apparatus is run-in-hole; and a shear mechanism for shearing the shear pin in response to the apparatus engaging a downhole tool.

Statement 20. The apparatus of statement 19, wherein the shear mechanism comprises an interface surface, wherein the shear mechanism is actuatable in response to the interface surface contacting a corresponding surface of the downhole tool.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present embodiments are well adapted to attain the ends and advantages mentioned as well as those that are inherent therein. The particular embodiments disclosed above are illustrative only, as the present embodiments may be modified and practiced in different but equivalent manners apparent to those skilled in the art having the benefit of the teachings herein. Although individual embodiments are discussed, all combinations of each embodiment are contemplated and covered by the disclosure. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative embodiments disclosed above may be altered or modified and all such variations are considered within the scope and spirit of the present disclosure.

What is claimed is:

1. An apparatus, comprising:

a connector sub rigidly securable to a conveyance for running the connector sub along a wellbore, the connector sub having a connector lug;

a spool mandrel having a mandrel lug, wherein the spool mandrel is rotatable with respect to the connector sub; and an intermediate sub disposed between the connector sub and the spool mandrel, wherein the intermediate sub includes an intermediate lug extending outward from an outer surface of the intermediate sub, and wherein contact between the intermediate lug, the connector lug, and the mandrel lug bounds rotational movement of the spool mandrel with respect to the connector sub between a first angular position and a second angular position.

2. The apparatus of claim 1, wherein a first side of the connector lug is disposed proximate a first side of the intermediate lug and a first side of the mandrel lug is disposed proximate a second side of the intermediate lug in the first angular position of the spool mandrel.

3. The apparatus of claim 2, wherein the mandrel lug is configured to rotate away from the second side of the intermediate lug toward the first side of the intermediate lug in response to rotation of the spool mandrel in a first rotational direction, and wherein a second side of the mandrel lug contacts the first side of the intermediate lug to drive the intermediate lug away from the first side of the connector lug toward the second side of the connector lug in response to further rotation of the spool mandrel in the first rotational direction.

4. The apparatus of claim 3, wherein contact between the second side of the mandrel lug with the first side of the intermediate lug and contact between the second side of the intermediate lug and the second side of the connector lug bounds rotational movement of the spool mandrel with respect to the connector sub at the second angular position.

5. The apparatus of claim 1, wherein the connector lug and the mandrel lug are spaced apart axially to form a gap between the connector lug and the mandrel lug.

6. The apparatus of claim 1, wherein the connector lug interfaces with an uphole axial end of the intermediate lug, and wherein the mandrel lug interfaces with a downhole axial end of the intermediate lug.

7. The apparatus of claim 1, wherein the first angular position and the second angular position are between 630 to 720 degrees apart.

8. The apparatus of claim 1, further comprising a retainer sub disposed radially exterior to the connector sub and the spool mandrel, wherein the retainer sub restrains axial movement of the spool mandrel with respect to the connector sub to couple the spool mandrel to the connector sub.

9. The apparatus of claim 1, further comprising a shear pin and a shear mechanism, wherein the shear pin restrains rotational movement of the spool mandrel with respect to the connector sub as the apparatus is run-in-hole, and wherein the shear mechanism is configured to shear the shear pin in response to the apparatus engaging a downhole tool disposed in the wellbore.

10. The apparatus of claim 9, wherein the shear mechanism comprises a sleeve having a shear pin slot and an interface feature configured to engage the downhole tool, wherein the shear pin is disposed in the shear pin slot as the apparatus is run-in-hole, and wherein the sleeve is configured to slide axially to shear the shear pin in response to the interface feature engaging the downhole tool.

11. The apparatus of claim 10, wherein the interface feature comprises a protrusion extending radially outward from the sleeve, wherein the sleeve is configured to slide axially to shear the shear pin in response to the protrusion engaging the downhole tool.

12. The apparatus of claim 10, wherein the interface feature comprises a retractable interface pin, wherein the retractable interface pin is in a radially extended position as the apparatus is run-in-hole, and wherein the sleeve is configured to slide axially to shear the shear pin in response to the retractable interface pin engaging the downhole tool.

13. The apparatus of claim 12, wherein the sleeve of the shear mechanism is slidable from a first axial position to a second axial position in response to the shear pin shearing, wherein the retractable interface pin is configured to retract into a corresponding slot formed in a retainer sub in the second axial position.

14. The apparatus of claim 10, wherein the shear mechanism further comprises a locking mechanism configured to secure the sleeve in a locked position that is axially offset from the first position with the shear pin.

15. An apparatus, comprising:

a connector sub rigidly securable to a conveyance for running the connector sub along a wellbore, the connector sub having an axially extending connector lug;

a spool mandrel having an axially extending mandrel lug, wherein the spool mandrel is rotatable with respect to the connector sub;

an intermediate sub disposed between the connector sub and the spool mandrel, wherein the intermediate sub includes an intermediate lug extending radially outward from an outer surface of the intermediate sub, and wherein contact between the intermediate lug, the connector lug, and the mandrel lug bounds rotational movement of the spool mandrel with respect to the connector sub between a first angular position and a second angular position;

at least one return spring configured to bias the spool mandrel to rotate toward an initial angular position of the spool mandrel with respect to the connector sub; and a control line extending between the connector sub and the spool mandrel, wherein the control line is displaceable to permit rotation of the spool mandrel with respect to the connector sub.

16. The apparatus of claim 15, wherein the at least one return spring is configured to bias the spool mandrel to rotate toward the first angular position of the spool mandrel with respect to the connector sub.

17. The apparatus of claim 15, wherein the at least one return spring comprises a first return spring and a second return spring, wherein a first end of the first return spring is attached to the spool mandrel and a second end of the first return spring is attached to the intermediate sub, and wherein and a first end of the second return spring is attached to the intermediate sub and a second end of the second return spring is attached to the connector sub.

18. The apparatus of claim 15, wherein the at least one return spring comprises a compression spring, a tension spring, a torsion spring, or some combination thereof.

19. An apparatus, comprising:

a connector sub rigidly securable to a conveyance for running the connector sub along a wellbore, the connector sub having an axially extending connector lug;

a spool mandrel having an axially extending mandrel lug, wherein the spool mandrel is rotatable with respect to the connector sub;

an intermediate sub disposed between the connector sub and the spool mandrel, wherein the intermediate sub includes an intermediate lug extending radially outward from an outer surface of the intermediate sub, and wherein contact between the intermediate lug, the connector lug, and the mandrel lug bounds rotational movement of the spool mandrel with respect to the connector sub between a first angular position and a second angular position;

a return spring configured to bias the spool mandrel to rotate toward an initial angular position of the spool mandrel with respect to the connector sub; and a control line extending between the connector sub and the spool mandrel, wherein the control line is displaceable to permit rotation of the spool mandrel with respect to the connector sub;

a retainer sub disposed radially exterior to the connector sub and the spool mandrel, wherein the retainer sub restrains axial movement of the spool mandrel with respect to the connector sub;

a shear pin for restraining rotational movement of the spool mandrel with respect to the connector sub as the apparatus is run-in-hole; and a shear mechanism for shearing the shear pin in response to the apparatus engaging a downhole tool.

20. The apparatus of claim 19, wherein the shear mechanism comprises an interface surface, wherein the shear mechanism is actuatable in response to the interface surface contacting a corresponding surface of the downhole tool.

* * * * *